US010397713B2

(12) United States Patent
Lindberg

(10) Patent No.: US 10,397,713 B2
(45) Date of Patent: Aug. 27, 2019

(54) EARPIECE FOR A HEARING DEVICE AND A HEARING DEVICE

(71) Applicant: GN Hearing A/S, Ballerup (DK)

(72) Inventor: Erik Alan Lindberg, Hampshire, IL (US)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 15/690,784

(22) Filed: Aug. 30, 2017

(65) Prior Publication Data

US 2019/0069105 A1 Feb. 28, 2019

(51) Int. Cl.
*H04R 1/10* (2006.01)
*H04R 25/00* (2006.01)

(52) U.S. Cl.
CPC ..... *H04R 25/652* (2013.01); *H04R 1/1033* (2013.01); *H04R 25/604* (2013.01); *H04R 1/1016* (2013.01); *H04R 2225/025* (2013.01)

(58) Field of Classification Search
CPC .. H04R 1/1016; H04R 1/1058; H04R 1/1091; H04R 1/1075; H04R 1/1066; H04R 1/105; H04R 2460/11; H04R 2420/07; H04R 25/652; H04R 1/1033
USPC ..... 381/380, 370, 328
See application file for complete search history.

(56) References Cited

U.S. PATENT DOCUMENTS

2012/0063622 A1* 3/2012 Bruckhoff ..... A61F 11/008 381/328
2014/0193013 A1 7/2014 Pedersen et al.
2016/0173969 A1* 6/2016 DeKalb ..... G10K 11/17881 381/380
2017/0049335 A1 2/2017 Duddy

FOREIGN PATENT DOCUMENTS

GB 2520267 A 5/2015
WO WO 2014/146702 A1 9/2014
WO WO 2014/146741 A1 9/2014

OTHER PUBLICATIONS

Extended European Search Report dated Jan. 4, 2019 for corresponding European Application No. 18181694.3.

* cited by examiner

*Primary Examiner* — Curtis A Kuntz
*Assistant Examiner* — Julie X Dang
(74) *Attorney, Agent, or Firm* — Vista IP Law Group, LLP

(57) ABSTRACT

An earpiece for a hearing device, includes: an earpiece housing comprising an ear canal part and an intermediate part, wherein the ear canal part extends along an ear canal axis of the earpiece, with an ear canal plane of the earpiece being perpendicular to the ear canal axis, the ear canal part having a first end, the intermediate part having a first end and a second end and extending along an intermediate axis; and a cable with a first end connected to the intermediate part, the cable exiting the intermediate part along a cable exit axis, the cable exit axis forming a first exit angle with respect to the ear canal plane, wherein the first exit angle is in a range from 5 to 45 degrees.

15 Claims, 5 Drawing Sheets

EARPIECE FOR A HEARING DEVICE AND A HEARING DEVICE

FIELD

The present disclosure relates to an earpiece for a hearing device, an in particular for a hearing device with hearing protection.

BACKGROUND

Earpieces are used in a large variety of situations, where an audio signal is presented to the user via the earpiece. Further, earpieces are used in communication systems for presenting to and/or receiving audio signals from the user.

In two-part hearing devices with an earpiece and an external device, the earpiece is connected to the external device by a cable comprising one or more wires and/or a sound guiding channel.

Earpieces for hearing devices are typically worn for many hours and therefore wearing comfort is of key importance for a hearing device user. In many hearing aids, the earpiece is specifically fitted to a hearing device user, which is a costly and tedious process.

SUMMARY

Accordingly, there is a need for hearing device earpieces with improved wearing comfort and which requires little or no customization.

Accordingly, an earpiece for a hearing device is provided, the earpiece comprising an earpiece housing and a cable. The earpiece housing comprises an ear canal part and an intermediate part, the ear canal part extending along an ear canal axis with an ear canal plane perpendicular to the ear canal axis, the ear canal part having a first end, the intermediate part having a first end and a second end and extending along an intermediate axis. The cable has a first end connected to the intermediate part, the cable exiting the intermediate part along a cable exit axis. The cable exit axis may form a first exit angle with respect to the ear canal plane. The first exit angle may be in the range from 5 to 45 degrees.

Further, a hearing device is provided, the hearing device comprising a processing part and an earpiece as disclosed herein, wherein the cable comprises a connector at a second end of the cable for connecting the processing part to the earpiece.

The present earpiece and hearing device provide improved wearing comfort to a user. Further, the earpiece reduces the need for customized fitting and/or allows for an ear piece with reduced size. In particular, a hearing device/earpiece with improved two-way communication is provided.

The disclosed earpiece reduces the requirement for complex processing of microphone signals.

An earpiece for a hearing device, includes: an earpiece housing comprising an ear canal part and an intermediate part, wherein the ear canal part extends along an ear canal axis of the earpiece, with an ear canal plane of the earpiece being perpendicular to the ear canal axis, the ear canal part having a first end, the intermediate part having a first end and a second end and extending along an intermediate axis; and a cable with a first end connected to the intermediate part, the cable exiting the intermediate part along a cable exit axis, the cable exit axis forming a first exit angle with respect to the ear canal plane, wherein the first exit angle is in a range from 5 to 45 degrees.

Optionally, the cable exit axis forming a second exit angle with respect to an intermediate plane perpendicular to the intermediate axis, wherein the second exit angle is in a range from 35 to 50 degrees.

Optionally, an angle between a projection of the intermediate axis in the ear canal plane, and a projection of the cable exit axis in the ear canal plane is in a range from 30 to 60 degrees.

Optionally, the intermediate axis forming a first intermediate angle with respect to the ear canal axis, wherein the first intermediate angle is in a range from 45 degrees to 90 degrees.

Optionally, wherein a distance between the projected exit axis and the ear canal axis in the ear canal plane is in a range from 2 mm to 15 mm.

Optionally, the earpiece further includes a microphone arranged in the earpiece housing, wherein the earpiece housing has a first microphone opening at a distance less than 3 mm from the ear canal axis.

Optionally, the earpiece further includes a protection element, the protection element comprising a foamed polymer and circumventing the ear canal part for forming a seal between an ear canal wall and the ear canal part.

Optionally, the intermediate part has a length in a range from 3 mm to 30 mm.

Optionally, the intermediate part has a height in a range from 3 mm to 20 mm.

Optionally, the earpiece housing comprises a first portion and a second portion, the first portion forming the ear canal part and a part of the intermediate part, and the second portion forming another part of the intermediate part, the first and second portion assembled along a seam line, the seam line at least partly extending in a seam plane with a seam plane normal, wherein an angle between the intermediate axis and the seam plane normal is in a range from 75 to 105 degrees.

Optionally, the cable exits the intermediate part within a cable exit distance of less than 8 mm from the first end of the intermediate part.

Optionally, the first exit angle is in a range from 10 degrees to 30 degrees.

Optionally, the second exit angle is a range from 35 degrees to 50 degrees.

Optionally, the first intermediate angle is in a range from 75 degrees to 85 degrees.

The earpiece may include any of the above features, or any combination of the above features.

A hearing device includes a processing part and the earpiece according to any of the embodiments described herein, wherein the cable comprises a connector at a second end of the cable for connecting the processing part to the earpiece.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
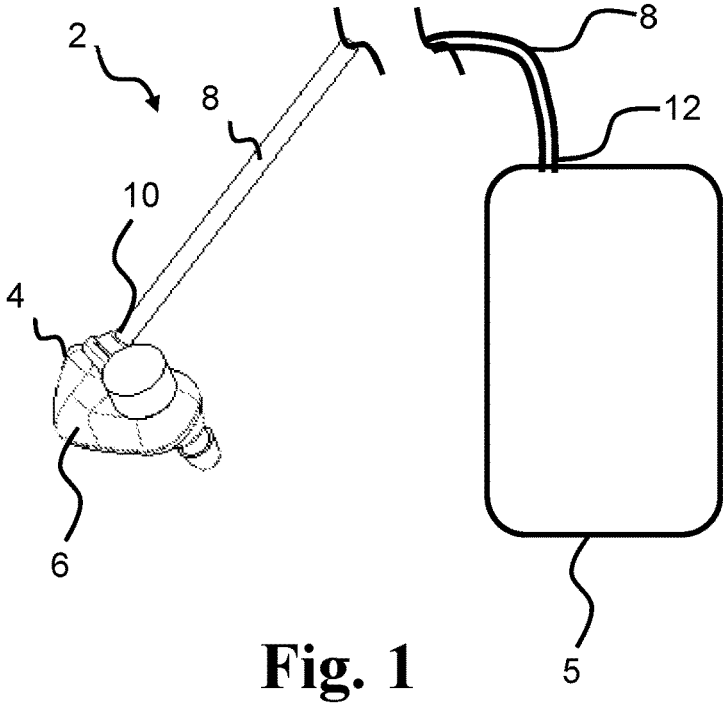
FIG. 1 schematically illustrates an exemplary hearing device.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to a hearing device and an ear piece for a hearing device. The hearing device may be a hearing aid or a hearable.

The hearing device may be of the behind-the-ear (BTE) type, or receiver-in-the-ear (RITE) type. The hearing aid may be a binaural hearing aid. The hearing device may comprise a first earpiece and a second earpiece, wherein the first earpiece and/or the second earpiece is/are an earpiece as disclosed herein. The hearing device/earpiece may be a hearing protector. The hearing protector may comprise a first earpiece and a second earpiece, wherein the first earpiece and/or the second earpiece is an earpiece as disclosed herein.

The earpiece comprises an earpiece housing. The earpiece housing may be configured for positioning in the ear of a user, such as in the concha and in the ear canal. The earpiece housing comprises an ear canal part and an intermediate part. The ear canal part extends along an ear canal axis of the earpiece, with an ear canal plane of the earpiece being perpendicular to the ear canal axis, the ear canal part having a first end. The first end of the ear canal part points towards the eardrum of a user when the earpiece is inserted into the ear of a user. A first sound opening may be arranged at the first end of the ear canal part. The first sound opening of the earpiece may have a diameter in the range from 0.5 mm to 5 mm, such as in the range from 1.5 mm to 4 mm, e.g. 3.0 mm.

The ear canal part may have an outer diameter (measured perpendicular to the ear canal axis) in the range from 2 mm to 6 mm. The ear canal part may have a first outer diameter at the first end in the range from 1 mm to 3 mm. The outer diameter of the ear canal part may vary along the ear canal axis, e.g. to facilitate attachment of a protection element on the ear canal part.

Preferably, the ear canal part forms at least a first audio channel part of an audio channel from the first end (first sound opening) to a receiver (loudspeaker) and/or a microphone, e.g. arranged in the earpiece. The first audio channel part may have a diameter in the range from 0.5 mm to 5 mm, such as in the range from 1.5 mm to 4 mm, e.g. 3.0 mm.

The ear canal part may have a length (measured along the ear canal axis) in the range from 2 mm to 20 mm. In one or more exemplary earpieces, the ear canal part has a length in the range from 3 mm to 10 mm. Thereby, the ear canal wall of the user can be used for fixating/positioning the earpiece in the ear canal and/or the ear canal can be sealed inside the ear canal, e.g. by a sealing functionality of the ear canal part of the ear piece.

The intermediate part has a first end and a second end and extending along an intermediate axis. The intermediate axis may be a longitudinal axis of the intermediate part. The intermediate part has a length (extension from first end to second end), preferably in the range from 3 mm to 30 mm. The length of the intermediate part may be in the range from 10 mm to 20 mm, e.g. to allow for positioning in the conchae and at the same time provide sufficient volume for earpiece components.

The intermediate part may have a height in the range from 3 mm to 20 mm. The height of the intermediate part may be in the range from 7 mm to 13 mm, e.g. to allow for positioning in the conchae and at the same time provide sufficient volume for earpiece components.

The earpiece comprises a cable with a first end connected to the intermediate part, the cable exiting the intermediate part along a cable exit axis, the cable exit axis forming a first exit angle with respect to the ear canal plane. The first exit angle is also denoted $\alpha$_1 and may be in the range from 5 to 45 degrees. In one or more exemplary earpieces, the first exit angle is in the range from 10 to 30 degrees, such as from 18 degrees to 25 degrees. The first exit angle may be in the range from 20 to 23 degrees, e.g. about 21.5 degrees, such as 21.5 degrees+/−2%. Thereby, the cable exits the ear in a suitable direction allowing the intermediate part and/or a first microphone opening of the intermediate part/earpiece housing to be placed close to or at a short distance (measured along the ear canal axis) from the ear canal opening.

The cable may comprise one or more wires for electrically connecting parts of the earpiece, such as a receiver (loudspeaker) and one or more microphones, to a processor part of the hearing device. In one or more exemplary hearing devices, the cable may comprise a plurality of wires for electrically connecting parts of the earpiece, such as a receiver (loudspeaker) and one or a plurality of microphones, to a processor part of the hearing device.

The cable exit axis may form a second exit angle also denoted $\alpha$_2 with respect to an intermediate plane perpendicular to the intermediate axis. The second exit angle may be in the range from 30 to 60 degrees, such as in the range from 35 to 50 degrees. The second exit angle may be in the range from 38 to 43 degrees, such as about 40.5 degrees, such as e.g. 40.5 degrees+/−2%.

The intermediate axis may be projected into a projected intermediate axis in the ear canal plane and the exit axis may be projected into a projected exit axis in the ear canal plane. The angle between the projected intermediate axis and the projected exit axis is also denoted $\alpha$_3 and may be in the range from 25 to 70 degrees, such as in the range from 30 to 60 degrees. The angle between the projected intermediate axis and the projected exit axis may be in the range from 33 to 38 degrees, e.g. about 35.5 degrees, such as 35.5 degrees+/−2%. The angle between the projected intermediate axis and the projected exit axis may be in the range from 45 to 50 degrees, e.g. about 48 degrees, such as 48 degrees+/−2%.

The intermediate axis may form a first intermediate angle also denoted $\beta$_1 with respect to the ear canal axis. The first intermediate angle is in the range from 45 to 90 degrees. The first intermediate angle may be in the range from 60 to 87 degrees, such as from 75 to 85 degrees. In one or more exemplary earpieces, the first intermediate angle is about 80 degrees. A first intermediate angle smaller than 90 degrees, e.g. a slightly angled ear canal plane (e.g. 5 to 15 degrees)

in relation to the intermediate axis, allows for an earpiece that utilizes the available space in the concha.

A distance between the projected exit axis and the ear canal axis in the ear canal plane may be in the range from 2 mm to 20 mm, such as about 10 mm. Thereby, the first exit axis is shifted away from the ear canal axis, e.g. enabling arrangement of a first microphone opening close to or coinciding with the ear canal axis.

The earpiece may comprise one or more microphones arranged in the earpiece housing, such as a first microphone and/or a second microphone arranged in the intermediate part. The first microphone may be configured to receive audio from the surroundings, e.g. via first microphone in intermediate part. The second microphone may be an ear canal microphone configured to receive audio from the ear canal, e.g. via the first sound opening/first audio channel part in the ear canal part.

For example, the earpiece may comprise a first microphone arranged in the earpiece housing, wherein the earpiece housing has a first microphone opening at a distance from the ear canal axis. The distance from the first microphone opening (center) to the ear canal axis (also denoted d_mic1) may be less than 3 mm. In one or more exemplary earpieces, the distance d_mic1 is less than 1 mm. The first microphone opening may coincide with the ear canal axis. A first microphone opening close to the ear canal axis reduces the need for complex processing of first microphone signal from the first microphone, e.g. application of head related transfer function (HRTF).

The earpiece may be a hearing protector. Thus, the earpiece may comprise a protection element for forming a seal between the ear canal wall and the ear canal part. The protection element may be made of or comprise foamed polymer. The protection element may circumvent the ear canal part. The earpiece may comprise one or more cavities, optionally including a receiver cavity and/or a microphone cavity. The receiver and/or the receiver housing may be arranged or accommodated in the receiver cavity. The first microphone and/or the second microphone may be arranged in the microphone cavity. In one or more exemplary earpieces, the second microphone is arranged in the receiver cavity. The earpiece housing may comprise an internal wall for at least partly forming or defining the receiver cavity and/or the microphone cavity. The earpiece may comprise a lid element, e.g. for sealing a receiver cavity of the earpiece and/or separating the receiver cavity and the microphone cavity. Thus, the lid element may define or form a part of the receiver cavity.

The earpiece may comprise a filling material at least partly or fully filling one or more cavities of the earpiece, such as the microphone cavity. The filling material may partly or fully fill the microphone cavity, e.g. such that an air volume in the microphone cavity is less than 50% of the microphone cavity volume, such as less than 20% or even less than 10% of the microphone cavity volume. In one or more exemplary earpieces, an air volume in the microphone cavity is less than 2% of the microphone cavity volume. A small air volume in the microphone cavity contributes to the mechanical strength of the earpiece and/or functions as an internal protection element in reducing or preventing ambient sounds propagating through the inside of the earpiece housing. The filling material may be epoxy. The filling material may comprise one or more elastomers, such as silicone. The filling material may be configured as an internal protection element for preventing or heavily reducing audio transmission through the earpiece.

The earpiece may comprise a first sound guide structure for guiding sound from the first microphone opening in the earpiece housing to the first microphone. The first sound guide structure may comprise a primary sound guide element and/or a secondary sound guide element. The secondary sound guide element may be a printed circuit board with the first microphone mounted or integrated thereon. The first sound guide structure, e.g. the primary sound guide element, may have an input opening for feeding sound or audio into an audio channel of the first sound guide structure. The first sound guide structure, e.g. the secondary sound guide element, may have an output opening for feeding sound or audio from the audio channel of the first sound guide structure to the first microphone. A distance between the input opening of the primary sound guide element and the output opening of the secondary sound guide element may be at least 3 mm, e.g. when measured in the direction of the intermediate axis. In other words, the audio channel of the first sound guide structure may have a length of at least 3 mm, such as at least 6 mm.

The earpiece housing optionally comprises a first portion and a second portion. The first portion may form the ear canal part and a part of the intermediate part. The second portion may form a part of the intermediate part. The first portion and the second portion may be assembled along a seam line. The seam line may at least partly (e.g. more than 50%) extend in a seam plane with a seam plane normal. A first seam angle between the intermediate axis and the seam plane normal may be in the range from 75 to 105 degrees, such as 90 degrees.

The cable may exit the intermediate part within a cable exit distance from the first end of the intermediate part. The cable exit distance may be less than 8 mm. The ear canal part may protrude from the intermediate part near the second end of the intermediate part, e.g. within a distance of less than 8 mm from the second end (along the intermediate axis).

The earpiece may comprise one or more microphones including a first microphone and/or a second microphone arranged within the earpiece housing. The earpiece may comprise a receiver arranged within the earpiece housing for providing an audio output signal to the ear canal/eardrum when the earpiece is inserted in the ear of the user.

The hearing device comprises a processing part. The processing part comprises a housing accommodating a processor for receiving and processing input signal(s) from the first and/or second microphone and providing an output signal for the receiver. The cable electrically connects or is configured to electrically connect components (microphones/receiver) of the earpiece and the processing part.

Table 1 shows different angles in degrees for exemplary earpieces A-F. The distance D_1 is given in mm.

TABLE 1

Angles for exemplary earpieces.

| | A | B | C | D |
|---|---|---|---|---|
| α_1 | 22 | 10-30 | 5-45 | 18-25 |
| α_2 | 41 | 35-50 | 30-60 | 38-43 |
| α_3 | 48 | 30-50 | 25-60 | 33-38 |
| β_1 | 80 | 60-87 | 45-90 | 75-85 |
| D_1 | 2-20 | 1-40 | 2-20 | 2-20 |

FIG. 1 shows an exemplary hearing device. The hearing device 2 comprises an earpiece 4 and a processing part 5, the earpiece 4 comprising an earpiece housing 6 and a cable 8 connected to the earpiece housing 6 at a first end 10 of the cable. A second end 12 of the cable 8 is connected or connectable to the processing part 5 of the hearing device 2.

Figure 2:
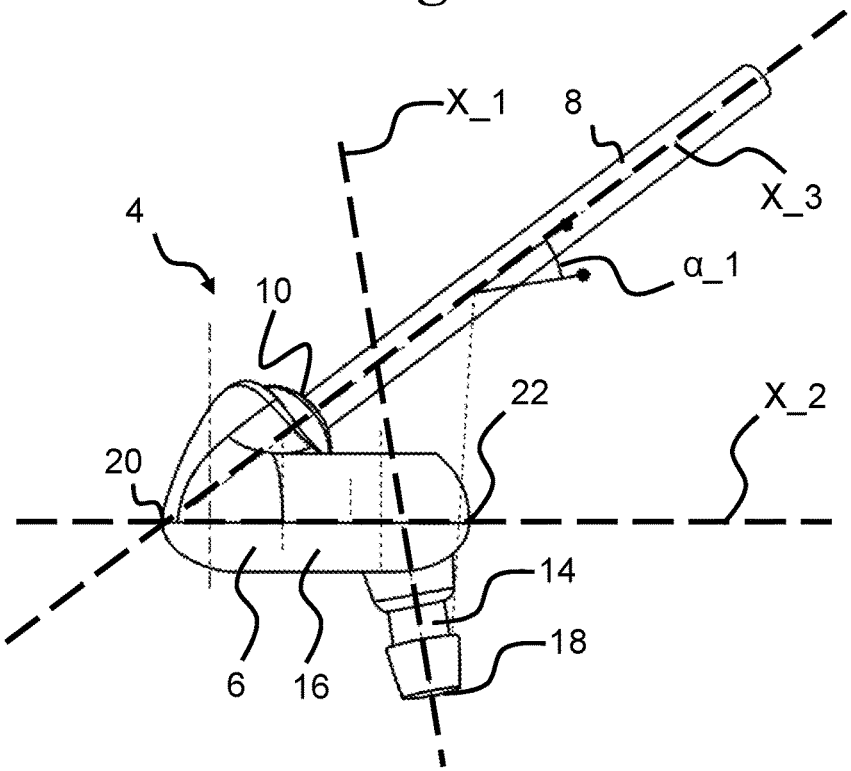
FIG. 2 is a first view of an exemplary earpiece.

FIG. 2 shows a first view of earpiece 4. The earpiece 4 comprises an earpiece housing 6 comprising an ear canal part 14 and an intermediate part 16. The ear canal part 14 extends along an ear canal axis X_1 with an ear canal plane perpendicular to the ear canal axis X_1. The ear canal part 14 has a first end 18, and the intermediate part 16 has a first end 20 and a second end 22 and extending along an intermediate axis X_2. The earpiece 4 comprises a cable 8 with a first end 10 connected to the intermediate part 16, the cable 8 exiting the intermediate part 16 along a cable exit axis X_3, the cable exit axis X_3 forming a first exit angle $\alpha$_1 with respect to ear canal plane perpendicular to the ear canal axis. The first exit angle $\alpha$_1 is about 21.5 degrees.

Figure 3:
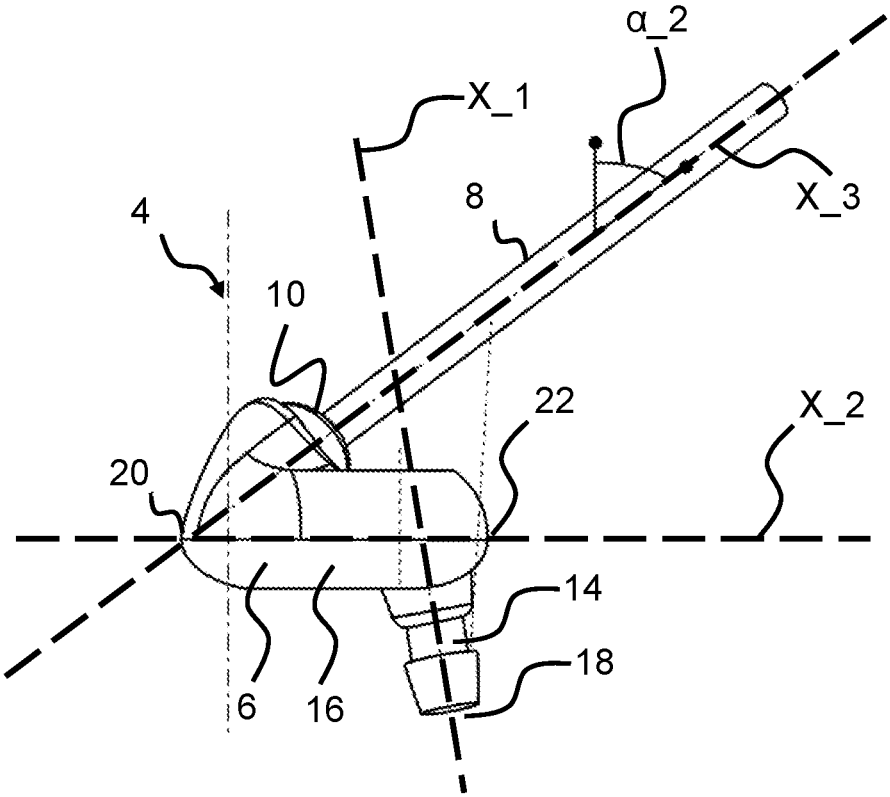
FIG. 3 is a first view of an exemplary earpiece.

FIG. 3 shows the first view of earpiece 4. The cable exit axis X_3 forms a second exit angle also denoted $\alpha$_2 with respect to an intermediate plane perpendicular to the intermediate axis X_2. The second exit angle $\alpha$_2 is about 40.5 degrees.

Figure 4:
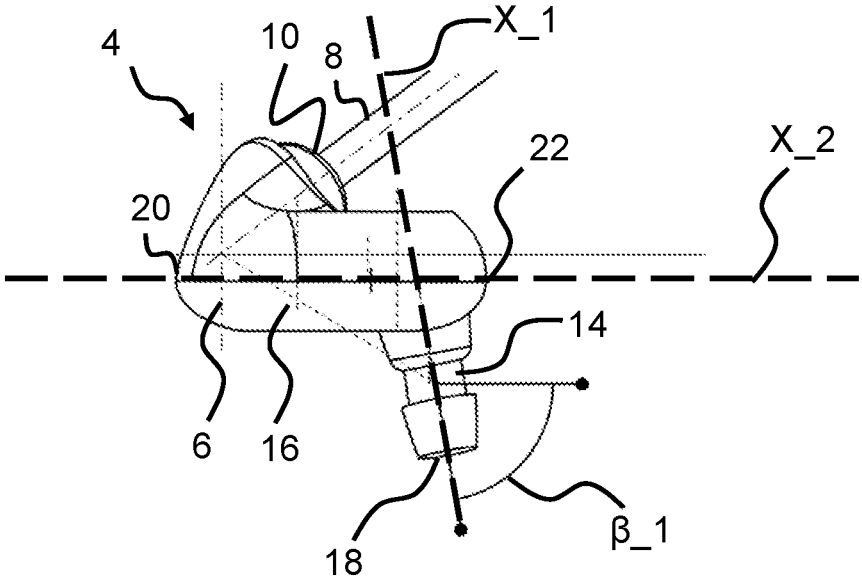
FIG. 4 is a first view of an exemplary earpiece.

FIG. 4 shows the first view of earpiece 4. The intermediate axis X_2 forms a first intermediate angle $\beta$_1 with respect to the ear canal axis X_1. The first intermediate angle $\beta$_1 is about 80 degrees. A first intermediate angle smaller than 90 degrees, e.g. a slightly angled ear canal plane (e.g. 5 to 15 degrees) in relation to the intermediate axis, allows for an earpiece that utilizes the available space in the concha.

Figure 5:
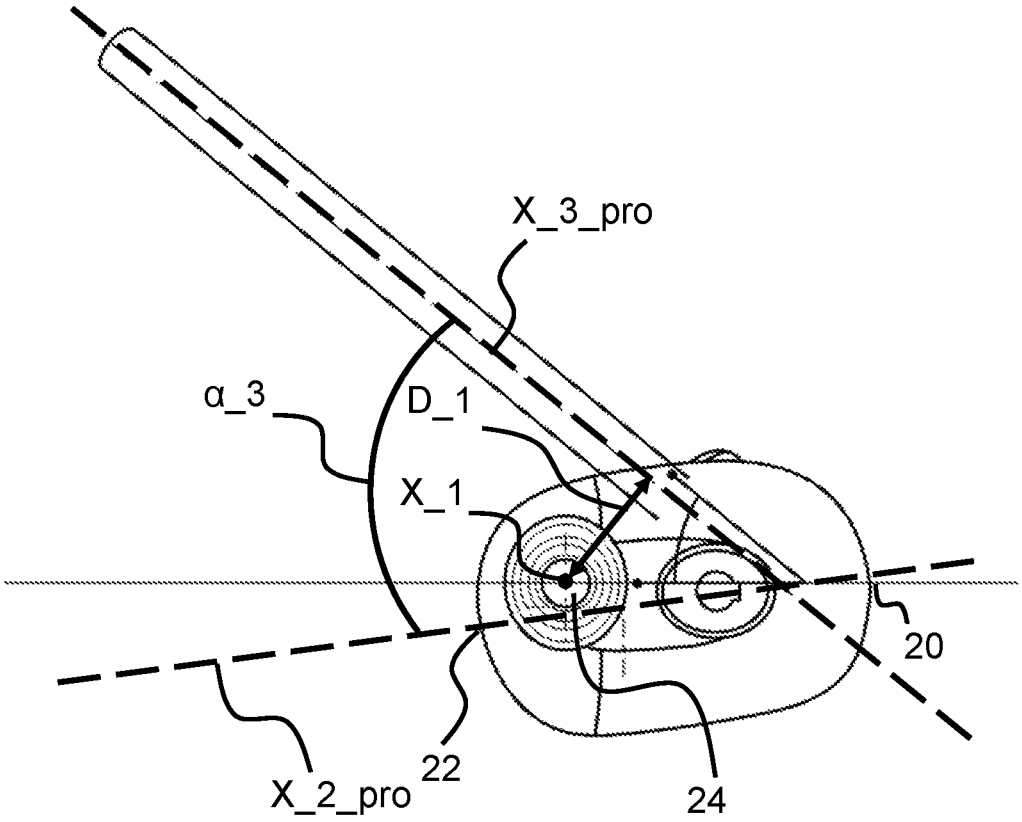
FIG. 5 is a second view of an exemplary earpiece.

FIG. 5 shows a second view of the earpiece 4 as seen in the direction of the ear canal axis. A first sound opening 24 is arranged at the first end 18 of the ear canal part. The first sound opening 24 of the earpiece has a circular or oval cross-sectional shape with a (largest) diameter of about 3.0 mm and coincides with the ear canal axis. The intermediate axis X_2 is projected into a projected intermediate axis X_2_pro in the ear canal plane and the exit axis X_3 is projected into a projected exit axis X_3_pro in the ear canal plane. The angle between the projected intermediate axis X_2_pro and the projected exit axis X_3_pro is also denoted $\alpha$_3 and may be in the range from 25 to 70 degrees, such as in the range from 30 to 60 degrees. The angle between the projected intermediate axis and the projected exit axis may be in the range from 45 to 50 degrees, such as about 48 degrees The intermediate axis may form a first intermediate angle also denoted $\beta$_1 with respect to the ear canal axis. The first intermediate angle is in the range from 45 to 90 degrees. The first intermediate angle may be in the range from 60 to 87 degrees, such as from 75 to 85 degrees. In one or more exemplary earpieces, the first intermediate angle is about 80 degrees. A first intermediate angle smaller than 90 degrees, e.g. a slightly angled ear canal plane (e.g. 5 to 15 degrees) in relation to the intermediate axis, allows for an earpiece that utilizes the available space in the concha.

A distance D_1 between the projected exit axis X_3_pro and the ear canal axis X_1 in the ear canal plane may be in the range from 2 mm to 20 mm, such as 10 mm as illustrated. Thereby, the first exit axis is shifted away or distanced from the ear canal axis, e.g. enabling arrangement of a first microphone opening close to or coinciding with the ear canal axis.

Figure 6:
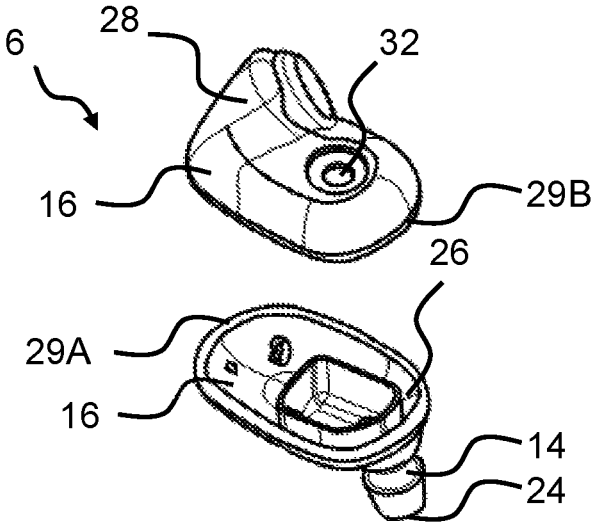
FIG. 6 schematically illustrates shell parts of an earpiece housing.

FIG. 6 shows a first portion 26 also denoted first shell part and a second portion 28 also denoted second shell part of the earpiece housing 6. The first portion 26 forms the ear canal part 14 and a part of the intermediate part 16. The second portion 28 forms a part of the intermediate part 16. The first portion 26 and the second portion 28 are assembled along respective first and second edges 29A, 29B forming a seam line extending in a seam plane with a seam plane normal. A first seam angle between the intermediate axis and the seam plane normal is in the range from 75 to 105 degrees. A second seam angle between the ear canal axis and the seam plane normal is in the range from 5 to 25 degrees. The second portion 28 has a first microphone opening 32 in the intermediate part for allowing external or surrounding sound to enter the inside of earpiece housing.

Figure 7:
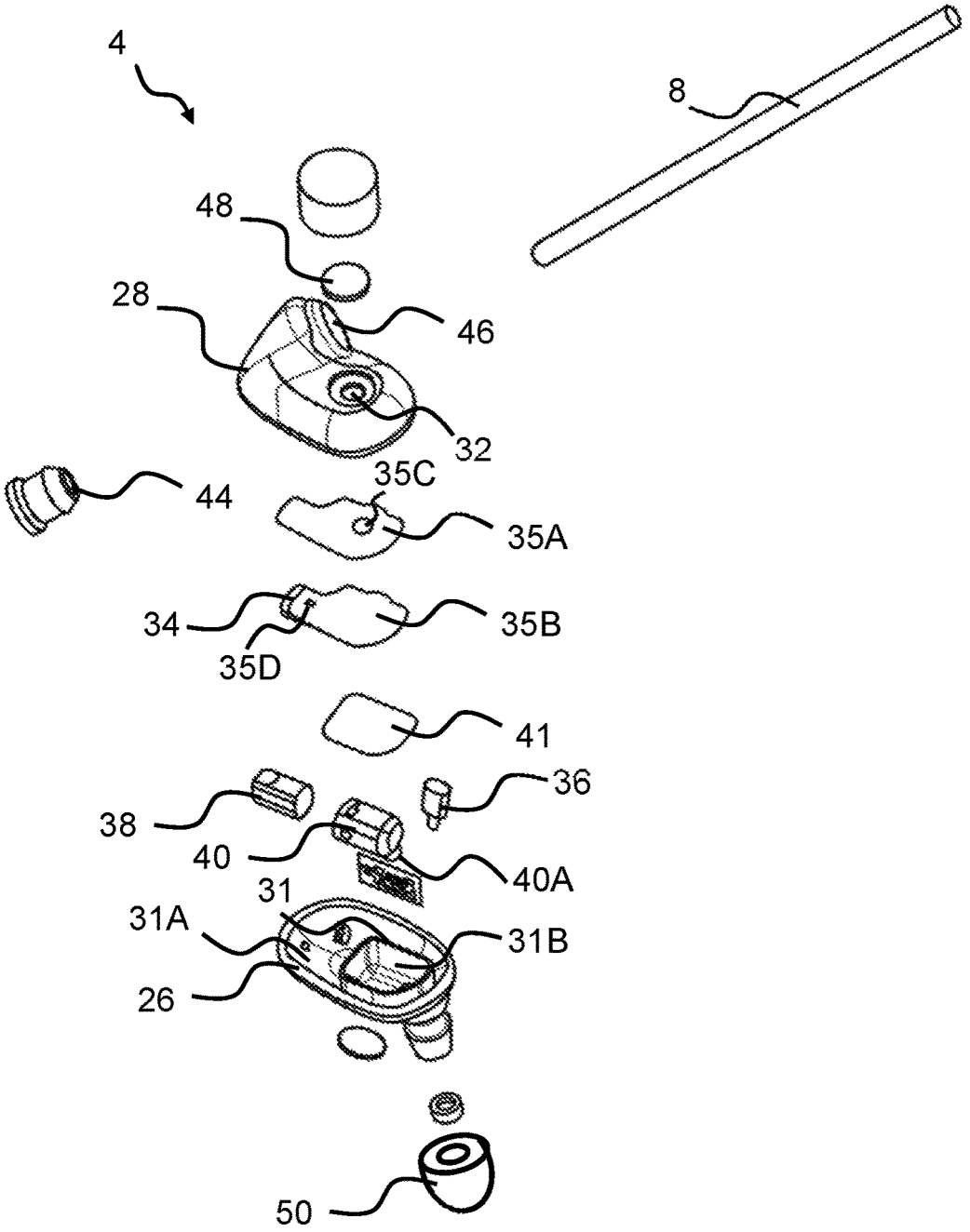
FIG. 7 is an exploded view of an exemplary earpiece.

FIG. 7 shows an exploded view of earpiece 4. The earpiece 4 comprises a first microphone 34 arranged in the intermediate part and configured to receive audio from the surroundings via first microphone opening 32 in intermediate part. The earpiece comprises a first sound guide structure comprising primary sound guide element 35A and secondary sound guide element 35B. The sound guide structure forms an audio path or channel between input opening 35C of the primary sound guide element 35A and output opening 35D of the secondary sound guide element 35B. The first microphone 34 is mounted on the secondary sound guide element 35B and receives ambient or external sound via the output opening 35D. The earpiece 4 comprises a second microphone 36 also denoted ear canal microphone and arranged at least partly in the intermediate part and configured to receive audio from the ear canal via first sound opening 24 at the first end of the ear canal part. The earpiece 4 comprises a receiver 38 (loudspeaker) that when assembled is arranged in receiver housing 40. The receiver 38 and the receiver housing 40 are, when the earpiece is assembled, arranged within receiver cavity 31B formed by internal wall 31 and lid element 41. The receiver 38 generates sound that is transmitted via spout 40A of the receiver housing 40 through audio channel in the earpiece housing (ear canal portion) from the outer ear portion to the first sound opening 24 at the first end of the ear canal portion. The internal wall 31 and the lid element 41 separates the microphone cavity 31A and the receiver cavity 31B. The receiver generates sound that is transmitted through audio channel in the earpiece housing (ear canal part) from the intermediate part to the first sound opening 24 at the first end of the ear canal part.

The first microphone opening 32 coincides with the ear canal axis thereby reducing the need for complex processing of first microphone signal from the first microphone due to the detection of a more lifelike input signal with the first microphone. The earpiece 4 optionally comprises a printed circuit board 42. Optional cable support 44 is configured to support cable 8 in cable port 46 of the intermediate part 16.

The earpiece 4 comprises a protection element 50 for forming a seal between the ear canal wall and the ear canal part 14. The protection element comprises foamed polymer and is configured to circumvent the ear canal part. The protection element 50 may be replaced by an ear canal adapter. The ear canal adapter may comprise a vent.

Figure 8:
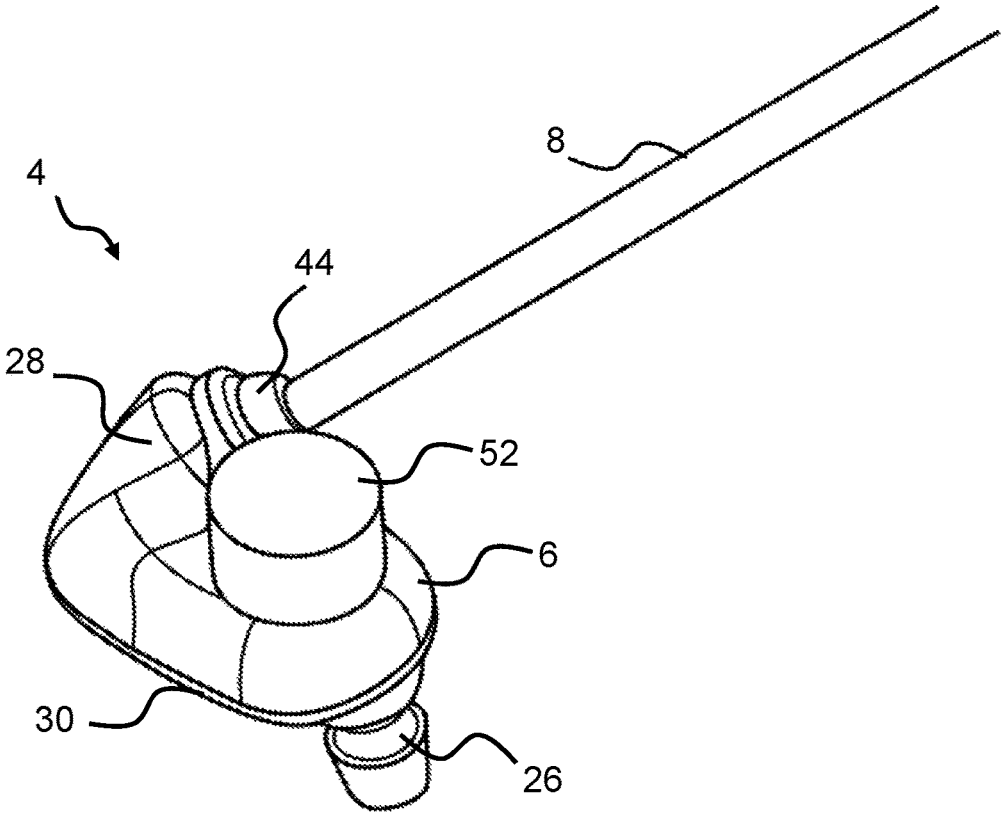
FIG. 8 shows a view of an earpiece.

FIG. 8 shows a third view of the earpiece 4. The first portion 26 and the second portion 28 of the earpiece housing 6 are assembled along seam line 30. Optionally, the earpiece 4 comprises a filter element 52 attached to the intermediate part of the earpiece housing 6, e.g. for reducing wind noise. A filling material (epoxy) has been filled into the microphone cavity to increase mechanical stress and function as an internal protection element.

The use of the terms "first", "second", "third" and "fourth", etc. does not imply any order, but are included to identify individual elements. Moreover, the use of the terms first, second, etc. does not denote any order or importance, but rather the terms first, second, etc. are used to distinguish one element from another. Note that the words first, second, etc. are used here and elsewhere for labelling purposes only and are not intended to denote any specific spatial or temporal ordering unless otherwise indicated. Furthermore, the labelling of a first element does not imply the presence of a second element and vice versa.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

2 hearing device
4 earpiece
5 processing part
6 earpiece housing
8 cable
10 first end of cable
12 second end of cable
14 ear canal part
16 intermediate part
18 first end of ear canal part
20 first end of intermediate part
22 second end of intermediate part
24 first sound opening
26 first portion of earpiece housing
28 second portion of earpiece housing
29A first edge
29B second edge
30 seam line
31 internal wall
31A microphone cavity
31B receiver cavity
32 first microphone opening
34 first microphone
35A primary sound guide element
35B secondary sound guide element
35C input opening of primary sound guide element
35D output opening of secondary sound guide element
36 second microphone
38 receiver
40 receiver housing
40A spout
41 lid element
42 printed circuit board
44 cable support
46 cable port
48 filter element
50 protection element
52 filter element
X_1 ear canal axis
X_2 intermediate axis
X_2_pro projected intermediate axis
X_3 cable exit axis
X_3_pro projected exit axis
$\alpha$_1 first exit angle
$\alpha$_2 second exit angle
$\alpha$_3 angle between the projected intermediate axis and the projected exit axis
$\beta$_1 first intermediate angle

The invention claimed is:

1. An earpiece for a hearing device, the earpiece comprising:

an earpiece housing comprising an ear canal part and an intermediate part, wherein the ear canal part extends along an ear canal axis of the earpiece, with an ear canal plane of the earpiece being perpendicular to the ear canal axis, the ear canal part configured to output sound along a sound output direction, the intermediate part having a first end and a second end and extending along an intermediate axis; and a cable with a first end connected to the intermediate part, the cable exiting the intermediate part along a cable exit axis, the cable exit axis forming a first exit angle with respect to the ear canal plane, wherein the first exit angle is in a range from 5 to 45 degrees, wherein an exiting direction of the cable has a directional component that is (1) parallel to the ear canal axis of the earpiece and (2) opposite from the sound output direction of the ear canal part.

2. The earpiece according to claim 1, the cable exit axis forming a second exit angle with respect to an intermediate plane perpendicular to the intermediate axis, wherein the second exit angle is in a range from 35 to 50 degrees.

3. The earpiece according to claim 1, wherein an angle between a projection of the intermediate axis in the ear canal plane, and a projection of the cable exit axis in the ear canal plane is in a range from 30 to 60 degrees.

4. The earpiece according to claim 1, the intermediate axis forming a first intermediate angle with respect to the ear canal axis, wherein the first intermediate angle is in a range from 45 degrees to 90 degrees.

5. The earpiece according to claim 3, wherein a distance between the projected exit axis and the ear canal axis in the ear canal plane is in a range from 2 mm to 15 mm.

6. The earpiece according to claim 1, further comprising a microphone arranged in the earpiece housing, wherein the earpiece housing has a first microphone opening at a distance less than 3 mm from the ear canal axis.

7. The earpiece according to claim 1, further comprising a protection element, the protection element comprising a foamed polymer and circumventing the ear canal part for forming a seal between an ear canal wall and the ear canal part.

8. The earpiece according to claim 1, wherein the intermediate part has a length in a range from 3 mm to 30 mm.

9. The earpiece according to claim 1, wherein the intermediate part has a height in a range from 3 mm to 20 mm.

10. The earpiece according to claim 1, wherein the earpiece housing comprises a first portion and a second portion, the first portion forming the ear canal part and a part of the intermediate part, and the second portion forming another part of the intermediate part, the first and second portion assembled along a seam line, the seam line at least partly extending in a seam plane with a seam plane normal, wherein an angle between the intermediate axis and the seam plane normal is in a range from 75 to 105 degrees.

11. The earpiece according to claim 1, wherein the cable exits the intermediate part within a cable exit distance of less than 8 mm from the first end of the intermediate part.

12. The earpiece according to claim 1, wherein the first exit angle is in a range from 10 degrees to 30 degrees.

13. The earpiece according to claim 2, wherein the second exit angle is a range from 35 degrees to 50 degrees.

14. The earpiece according to claim 4, wherein the first intermediate angle is in a range from 75 degrees to 85 degrees.

15. A hearing device comprising a processing part and the earpiece according to claim 1, wherein the cable comprises a connector at a second end of the cable for connecting the processing part to the earpiece.

* * * * *